US005641082A

United States Patent [19]

Grainger

[11] Patent Number: 5,641,082

[45] Date of Patent: Jun. 24, 1997

[54] PULL-OUT SHELF SUPPORT SYSTEMS

[75] Inventor: Allan Grainger, Aberdare, United Kingdom

[73] Assignee: Rack Engineering (91) Limited, Mid Glamorgan, United Kingdom

[21] Appl. No.: 504,805

[22] Filed: Jul. 19, 1995

[51] Int. Cl.[6] ..... A47F 5/00

[52] U.S. Cl. ..... 211/151; 211/175; 312/334.12

[58] Field of Search ..... 211/151, 175; 312/334.12, 334.13, 334.7, 334.8

[56] References Cited

U.S. PATENT DOCUMENTS

| | | | |
|---|---|---|---|
| 2,559,380 | 7/1951 | Wikman | 312/334.12 |
| 2,823,973 | 2/1958 | De Vere Carver et al. | 312/334.12 X |
| 3,465,897 | 9/1969 | Schumann et al. | 211/151 |
| 3,701,577 | 10/1972 | Fisher | 312/334.12 |
| 3,708,074 | 1/1973 | Fahey et al. | 211/151 |
| 4,482,066 | 11/1984 | Dykstra . | |
| 5,064,335 | 11/1991 | Bergeron et al. | 211/151 X |
| 5,470,144 | 11/1995 | Wen | 312/334.12 X |

FOREIGN PATENT DOCUMENTS

| | | |
|---|---|---|
| 8714720.3 | 2/1988 | Germany . |
| 350773 | 1/1961 | Switzerland . |

*Primary Examiner*—Robert W. Gibson, Jr.
*Attorney, Agent, or Firm*—Young & Thompson

[57] ABSTRACT

A shelf (17) on a frame (18,19) sits within a tray-like structure provided by an intermediate frame (8), while the latter is supported by rails (6) and rollers (7). When pushed back into the storage position, the shelf (17) is stopped by a bar on the frame (8), with the rollers (21) on the shelf (17) at the rear ends of slots (12) in side plates (9) of the frame (8). The intermediate frame (8) is arrested by the outer framework (1). To gain clear access, the shelf (17) is pulled out horizontally, and it can shift with respect to the intermediate frame (8) a distance corresponding to the length of the slots (12). When it reaches the limit of this travel, the frame (8) is entrained and continued pulling draws it out, running on the rollers (7) and (13). The limit of its travel is defined by stops but when achieved the shelf (17) is fully clear of the framework and thus fully accessible. To restore the storage position, the shelf is simply pushed in again.

7 Claims, 5 Drawing Sheets

PULL-OUT SHELF SUPPORT SYSTEMS

Figure 1:
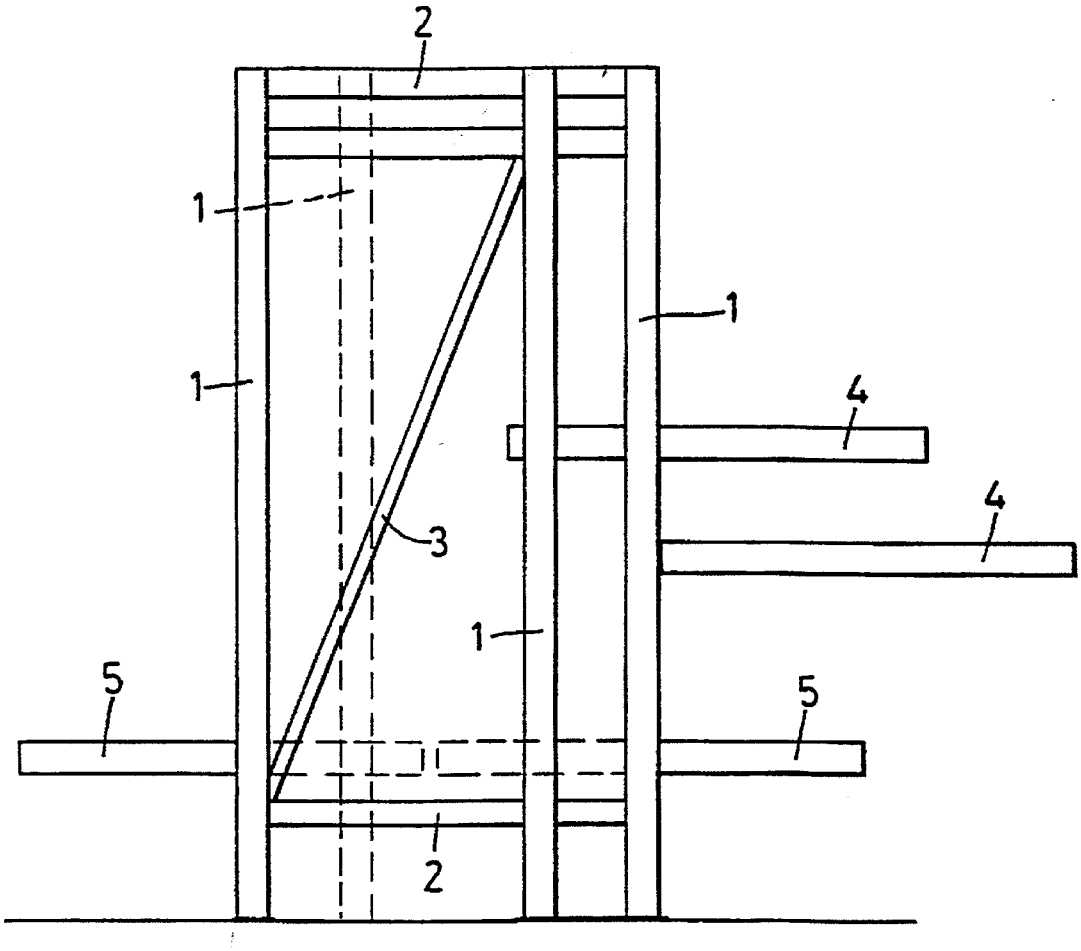

This invention relates to pull-out shelf support systems. It is primarily concerned with such systems for use in an industrial context, for example in racking for stores, where hundreds of different items may be held, some of them heavy and awkward to handle.

Conventionally, such racking is provided by framing assembled in rows with alleyways between. Fixed shelves have their limitations, since if they are too deep, items get lost at the back, or are, at least, difficult to see and retrieve, particularly with high racking, a narrow alleyway and top lighting.

It is therefore better, unless only very shallow shelving is required, to have pull-out shelves, bringing items at the middle and towards the back of the shelf out into the alleyway beyond the fixed framing. They can then be seen and easily taken.

However, the problem is that the shelf needs to be supported when drawn out, and in order to provide sufficient counteracting force to the tendency of the shelf to tip, it is usual for there to be a limit on the horizontal movement, leaving the rear portion of the shelf, perhaps up to one third of the total area, still within the fixed framing. Although this makes it better than fixed shelving, there are still access problems. It is desirable to have the shelf pulled out so that its total area is exposed.

Certain lightweight structures, such as filing cabinets, have solved this problem by the use of an intermediate runner at each side which travels by means of ball bearings or rollers on rails fixed to the cabinet and which itself provides ball bearing or roller support for a track on the drawer to run on. As the drawer is pulled out, the runners move with it, but travel half the distance.

While these have proved satisfactory in that context, scaling them up to support large shelves with heavy machine parts on them is not practical. It is the aim of this invention to provide a solution.

According to the present invention there is provided a pull-out shelf support system within a fixed frame comprising, for each side of a shelf, an intermediate member for travel partially with the shelf, and roller means for enabling the shelf to run on the intermediate members and the intermediate members to run with respect to the frame, characterised in that there are:

(i) First roller means journalled at the front of the frame to support the intermediate member, (ii) Second roller means journalled on the intermediate member and co-operating with a level track provided on or by the frame, (iii) Third roller means journalled at or near the forward end of the intermediate member to support the shelf, and (iv) Fourth roller means journalled at or near the rear of the shelf and co-operating with a level track provided on or by the intermediate member, the arrangement being such that, on pulling out the shelf, the latter shifts with respect to the intermediate members while being supported horizontally thereby, and the intermediate members shift with respect to the frame while being supported horizontally thereby.

Preferably, each track on the fixed frame comprises two horizontal rails one above the other. The second roller means may then be a wheel which runs between them, sometimes bearing on the lower rail (when the shelf is pushed in) and sometimes on the underside of the upper rail (when the shelf has been pulled out a certain distance).

Conveniently, each intermediate member has its track provided by an elongate slot. In a similar manner, the fourth roller means may then be a wheel within the slot bearing on the bottom edge or the top edge depending on the balance of the shelf and how much it has been pulled out.

Preferably, the intermediate members are not independent. They may form the sides of a frame underlying the shelf, and which therefore moves with the shelf when that is pulled out, although not to the same extent. By selection of tolerances and the frictional characteristics of the various roller means it can be ensured that the shelf completes its travel before the intermediate members start to move, or vice versa. There may be situations where this is more desirable than having simultaneous movement.

Figure 4:
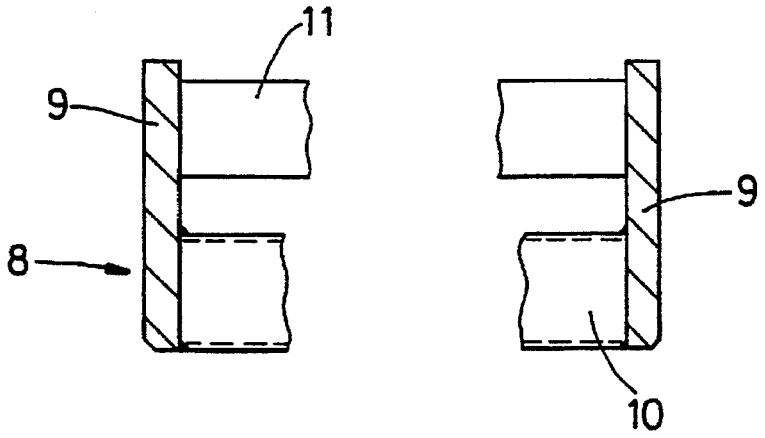
Figure 2:
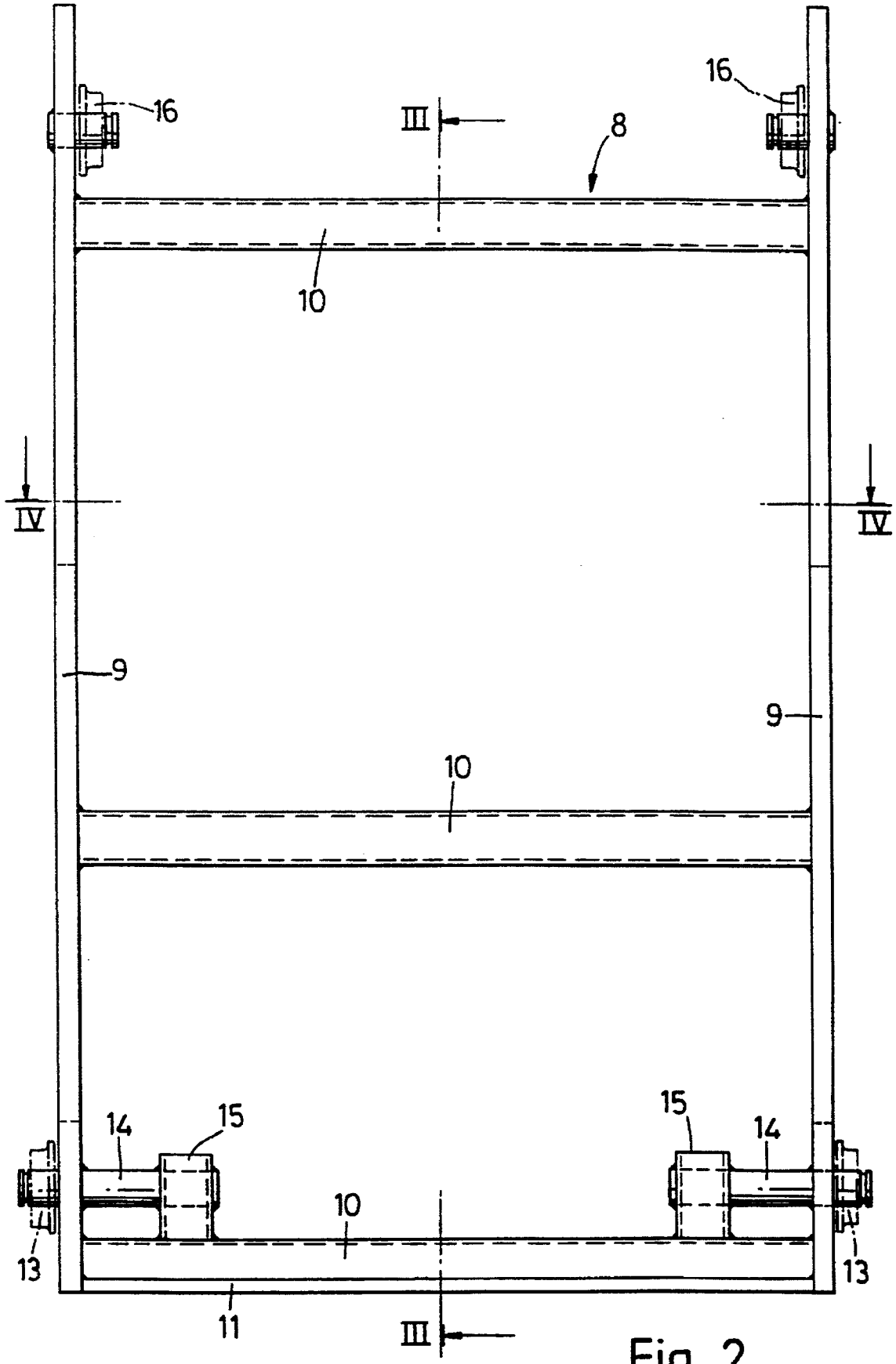
Figure 3:
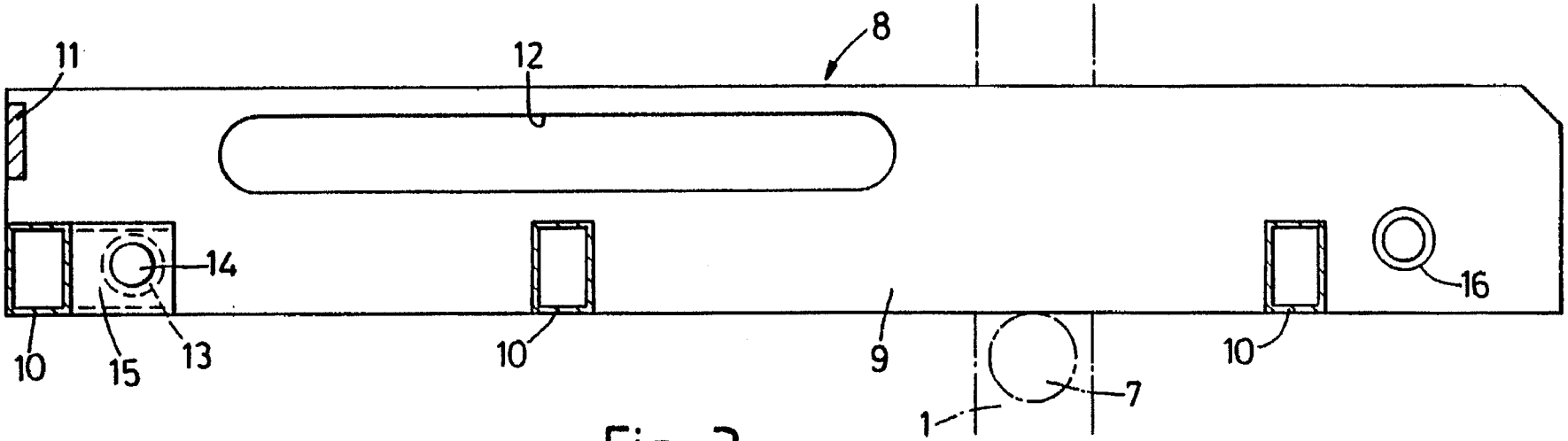
Figure 6:
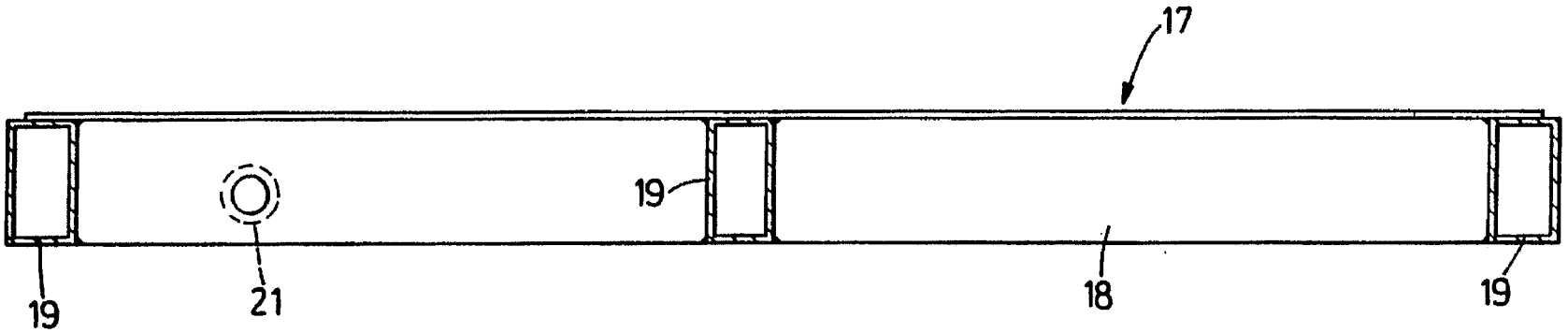
Figure 5:
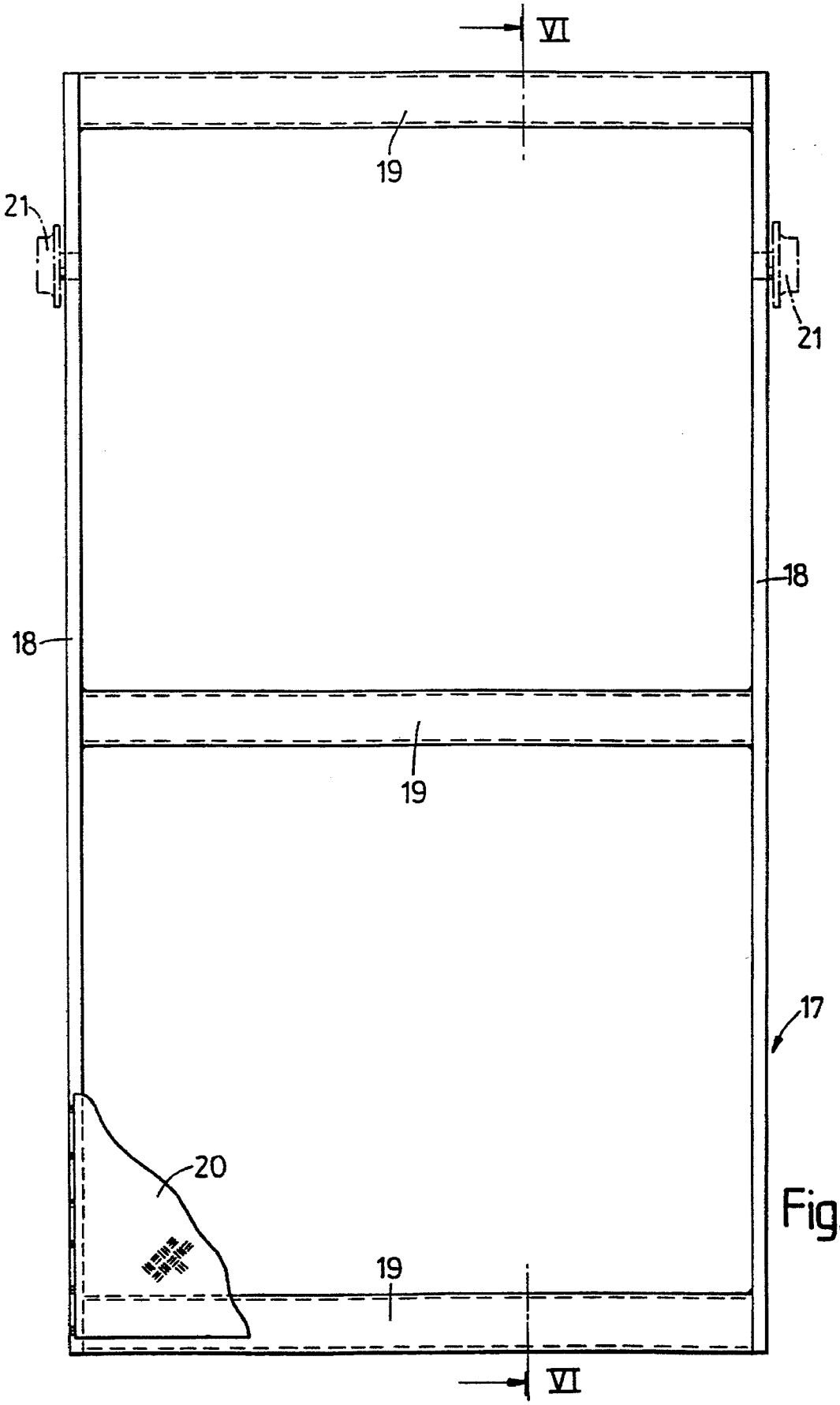
Figure 7:
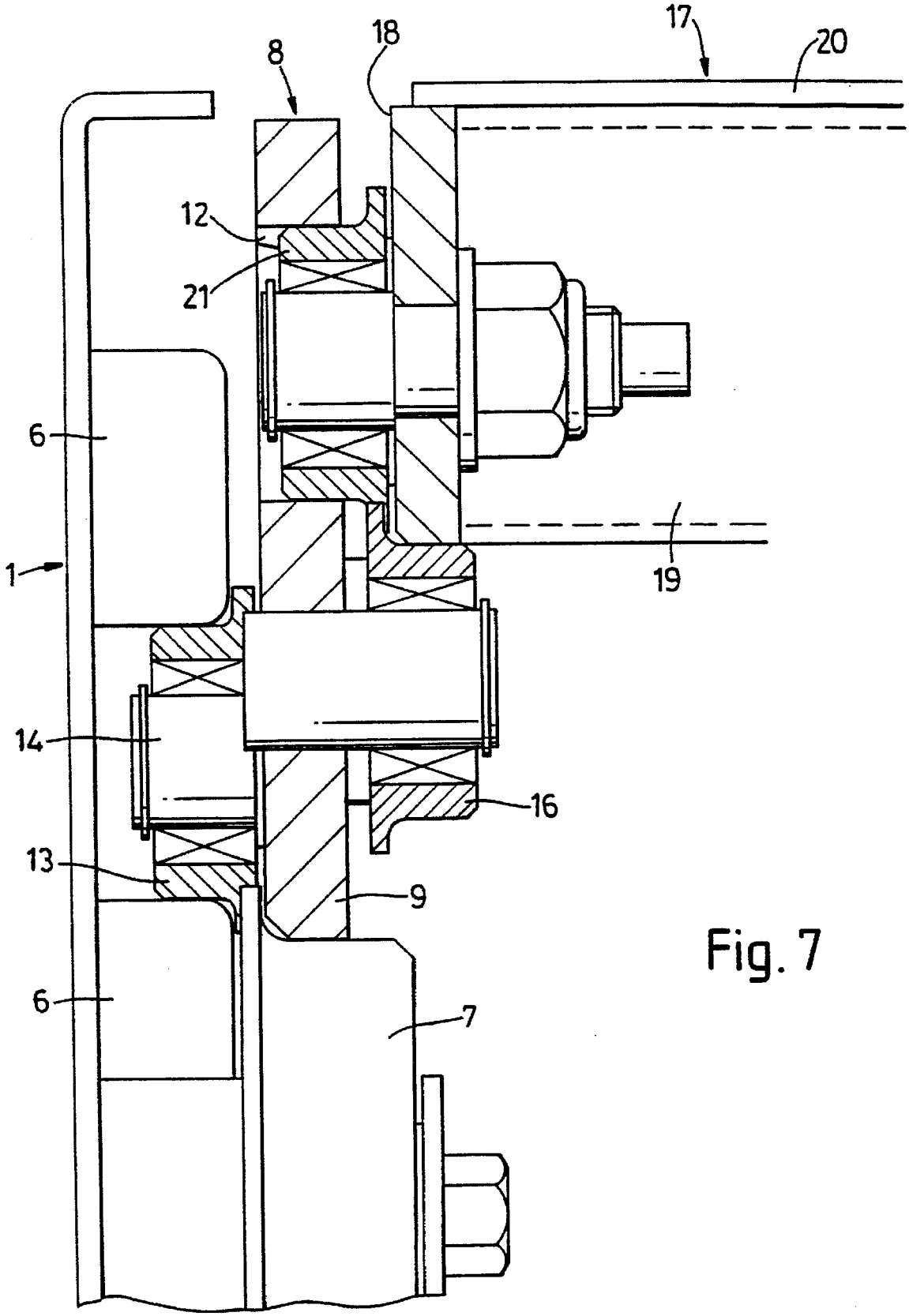

For a better understanding of the invention, one embodiment will now be described, by way of example, with reference to the accompanying drawings, in which:

FIG. 1 is a diagrammatic side elevation of a fixed frame containing pull-out shelving, FIG. 2 is a plan view of an intermediate moving frame, FIG. 3 is a section on the line III—III of FIG. 2, FIG. 4 is a fragmentary section on the line IV—IV of FIG. 2, FIG. 5 is a plan view of a pull-out shelf, FIG. 6 is a section on the line VI—VI of FIG. 5, and FIG. 7 is a fragmentary front elevation of one side of the fixed frame showing adjacent parts, some in vertical cross section, of the intermediate frame and shelf.

Referring to FIG. 1, a framework is constructed of metal angles and box sections to have uprights 1, horizontal members 2 and angled braces 3. Generally, construction is conventional and will not be described in detail. However, there is a variation indicated by the vertical dotted lines representing a possible fourth upright. This specification is primarily concerned with single entry shelving 4 which can only be pulled out one way, to the right as seen in FIG. 1. But double entry shelving is also possible, where a shelf 5 can be pulled out to one side or the other, as illustrated low down. For this, the extra upright may be needed.

Conventionally, a single entry shelf can only be pulled out so that about 60% of its plan area is exposed beyond the framework. This is indicated by the upper shelf 4. The object here is to increase that to 100% as indicated by the lower shelf 4.

At each shelf level, the sides of the framework are fitted with pairs of horizontal rails 6, one rail being above the other. At the front of the framework, each upright 1 has a roller 7 journalled on the inside, slightly below the rails 6. These rails and the rollers 7 support an intermediate frame 8 shown in FIGS. 2 and 3. This is rectangular in plan and comprises flat vertical plates 9 at each side spanned at intervals by box section beams 10. The plates 9 are substantially rectangular, their upper edges being well above the beams 10, and at the rear a flat bar 11 is welded between the plates 9 above the adjacent beam 10 to provide a stop.

Each side plate 9 has an elongate slot 12 with rounded ends extending lengthwise of it, starting a short distance from the rear end and terminating just beyond the mid point. To the rear of this slot 12, and centred below its lower edge, there is a roller 13 carried on the outside of the frame 8 by a short axle 14 extending through the plate and anchored in a block 15 secured to the front of the rear beam 10. Each roller 13 fits with a very small clearance between the associated rails 6 so that it either runs on the lower rail or engages the underside of the upper rail. At the forward end of the intermediate frame 8, the bottom edges of the side plates 9 bear on the rollers 7 fitted to the uprights 1.

Near the front of the intermediate frame 8, the side plates 9 carry further rollers 16 on the inside, their uppermost segments being proud of the beams 10.

Referring now to FIGS. 4 and 5, a shelf 17 is also basically a rectangular frame, having vertical rectangular side plates 18 spanned by beams 19. These support a rigid sheet 20 which provides the bearing surface of the shelf. Towards the rear of each plate 18 a roller 21 is journalled on the outside which engages in the associated slot 12 in similar fashion to the rollers 13 between the rails 6. The lower edge of each side plate 18 bears on the associated roller 16.

When the parts are assembled, the shelf 17 sits within the tray-like structure provided by the intermediate frame 8, while the latter is supported by the rails 6 and the rollers 7. When pushed back into the storage position, the shelf 17 is stopped by the bar 11, with the rollers 21 at the rear ends of the slot 12. The intermediate frame 8 is arrested by the framework.

To gain clear access, the shelf 17 is pulled out horizontally, and it can shift with respect to the intermediate frame 8 a distance corresponding to the length of the slots 12. When it reaches the limit of this travel, the frame 8 is entrained and continued pulling draws it out, running on the rollers 7 and 13. The limit of its travel is defined by stops (not shown) but when achieved the shelf 17 is fully clear of the framework and thus fully accessible.

To restore the storage position, the shelf is simply pushed in again.

For double entry shelving, the same principles can apply, but of course the intermediate frame 8 and the shelf 17 will be symmetrical, with the slot 12 and the rollers 13 and 21 central, and extra rollers 7 and 16. It would be advisable to have a catch arrangement, releasable from either end, to hold the shelf centred and to prevent overshoot when being pushed back into the frame.

I claim:

1. In a pull-out shelf support system within a fixed frame comprising, for each side of a shelf, an intermediate member for travel partially with the shelf, and roller means for enabling the shelf to run on the intermediate members and the intermediate members to run with respect to the frame; the improvement comprising (i) first roller means journalled at the front of the frame to support the intermediate member, (ii) second roller means journalled on the intermediate member and co-operating with a level track provided on or by the frame, (iii) third roller means journalled at or near the forward end of the intermediate member to support the shelf, and (iv) fourth roller means journalled at or near the rear of the shelf and co-operating with a level track provided on or by the intermediate member, the arrangement being such that, on pulling out the shelf, the latter shifts with respect to the intermediate members while being supported horizontally thereby, and the intermediate members shift with respect to the frame while being supported horizontally thereby.

2. A system according to claim 1, wherein each track on the fixed frame comprises two horizontal rails one above the other.

3. A system according to claim 2, wherein the second roller means is a wheel which runs between the two rails, sometimes bearing on the lower rail when the shelf is pushed in and sometimes on the underside of the upper rail when the shelf has been pulled out a certain distance.

4. A system according to any one of claim 1, wherein each intermediate member has its track provided by an elongate slot.

5. A system according to claim 4, wherein the fourth roller means is a wheel within said slot bearing on the bottom edge or the top edge depending on the balance of the shelf and how much it has been pulled out.

6. A system according to any one of claim 1 characterised in that the intermediate members are not independent.

7. A system according to claim 6, wherein the intermediate members form the sides of a frame underlying the shelf, and which therefore moves with the shelf when that is pulled out, although not to the same extent.

* * * * *